US012790925B2

(12) United States Patent
Thompson et al.

(10) Patent No.: US 12,790,925 B2
(45) Date of Patent: Nov. 10, 2026

(54) STEAM GENERATOR TOOL

(71) Applicant: General Energy Recovery Inc., Calgary (CA)

(72) Inventors: Daniel Thompson, Calgary (CA); Brian Kay, Calgary (CA); Wesley Sopko, Calgary (CA); Kevin Wiebe, Calgary (CA); Adrien Desmarais, Sherwood Park (CA); Bradley Dary, Calgary (CA)

(73) Assignee: General Energy Recovery Inc., Calgary (CA)

( * ) Notice: Subject to any disclaimer, the term of this patent is extended or adjusted under 35 U.S.C. 154(b) by 0 days.

(21) Appl. No.: 18/816,960

(22) Filed: Aug. 27, 2024

(65) Prior Publication Data

US 2024/0418066 A1 Dec. 19, 2024

Related U.S. Application Data

(62) Division of application No. 17/632,765, filed as application No. PCT/CA2020/051071 on Aug. 6, 2020, now Pat. No. 12,078,043.

(60) Provisional application No. 62/885,078, filed on Aug. 9, 2019.

(51) Int. Cl.
*E21B 43/243* (2006.01)
*E21B 36/02* (2006.01)

(52) U.S. Cl.
CPC ..... *E21B 43/243* (2013.01); *E21B 36/02* (2013.01)

(58) Field of Classification Search
CPC ..... E21B 43/243; E21B 36/02
See application file for complete search history.

(56) References Cited

U.S. PATENT DOCUMENTS 4,366,860 A * 1/1983 Donaldson ..... E21B 36/02 431/243
4,452,309 A 6/1984 Widmyer
4,540,052 A 9/1985 Hitzman
4,558,743 A 12/1985 Ryan et al.
4,574,886 A 3/1986 Hopkins et al.
(Continued)

FOREIGN PATENT DOCUMENTS

CN 86103584 A 10/1987
RU 2316648 C1 2/2008
(Continued)

*Primary Examiner* — Crystal J Lee
(74) *Attorney, Agent, or Firm* — Kunzler Needham Hilton

(57) ABSTRACT

The invention relates to a tool for generating steam and combustion gases for producing oil from an oil well. The tool includes a main body with a first end including a connection site for receiving a connection of an input line for fuel and/or water and an air inlet port configured to receive air from the atmosphere around the tool. The tool includes an ignition component arranged within the main body configured to ignite the air and the fuel to generate a flame. The tool includes a combustion chamber for accommodating the flame and extending at a second end of the main body opposite the first end, the combustion chamber defined by a wall and an outlet configured to allow exit of combusted products from the combustion chamber. The tool includes a passageway within the tool from the air inlet port to the combustion chamber.

18 Claims, 11 Drawing Sheets

(56) References Cited

U.S. PATENT DOCUMENTS

2015/0198025 A1* 7/2015 Baird ..... E21B 36/02
166/58

FOREIGN PATENT DOCUMENTS

RU 2007136457 A 4/2009
WO 2013053048 A1 4/2013

* cited by examiner

STEAM GENERATOR TOOL

CROSS-REFERENCE TO RELATED APPLICATIONS

This application is a divisional of U.S. patent application Ser. No. 17/632,765, which application claims priority, under 35 U.S.C. § 119, to International Application No. PCT/CA2020/051071, the entire disclosures of which are hereby incorporated herein by reference in their entireties.

FIELD OF THE INVENTION

The invention relates to a steam generator tool and in particular a steam generator tool and a method for generating steam from inputs of water, fuel and oxygen.

BACKGROUND

There are numerous oil reservoirs throughout the world that contain viscous hydrocarbons, often called "bitumen", "tar", "heavy oil", or "ultra heavy oil" (collectively referred to herein as "heavy oil"), where the heavy oil can have viscosities in the range of 3,000 to over 1,000,000 centipoise. The high viscosity hinders recovery of the oil since it cannot readily flow from the formation.

For economic recovery, heating the heavy oil, such as with steam injection, to lower the viscosity is the most common recovery method. Normally, heavy oil reservoirs would be produced by cyclic steam stimulation (CSS), steam drive (Drive), and steam assisted gravity drainage (SAGD), where steam is injected from the surface into the reservoir to heat the oil thereby reducing the oil viscosity enough for efficient production.

Surface injection of steam has a number of limitations due to inefficient surface boilers, energy loss in surface lines and energy loss in the well. Standard oil field boilers convert 85 to 90% of the fuel energy to steam, surface pipelines will lose 5 to 25% of the fuel energy depending on length of pipelines and insulation quality and lastly, the wellbore heat losses can be up to 5-15% of the fuel energy depending on well depth and insulating methods in the well. Thus, energy losses can total more than 50% of the fuel energy prior to the steam reaching the reservoir. In deep heavy oil reservoirs, surface steam injection often results in hot water, rather than steam, reaching the reservoir due to heat losses.

In addition, numerous heavy oil reservoirs will not respond to conventional steam injection since many have little or no natural drive pressure of their own. Even when reservoir pressure is initially sufficient for production, the pressure obviously declines as production progresses. Consequently, conventional steaming techniques are of little value in these cases, since the steam produced is at a low pressure, for example, several atmospheres. As a result, continuous injection of steam or a "steam drive" is generally out of the question. As a result, a cyclic technique, commonly known as "huff and puff" has been adopted in many steam injection operations. In this technique, steam is injected for a predetermined period of time, steam injection is discontinued and the well shut in for a predetermined period of time, referred to as a "soak". Thereafter, the well is pumped to a predetermined depletion point and the cycle repeated. However, the steam penetrates only a very small portion of the formation surrounding the well bore, particularly because the steam is injected at a relatively low pressure.

Another problem with conventional steam generation techniques is the production of air pollutants, namely, $CO_2$, $SO_2$, $NO_x$ and particulate emissions. Several jurisdictions have set maximum emissions for such steaming operations, which are generally applied over wide areas where large heavy oil fields exist and steaming operations are conducted on a commercial scale. Consequently, the number of steaming operations in a given field can be severely limited and in some cases it has been necessary to stage development to limit air pollution.

It has also been proposed to utilize high pressure combustion systems at the surface. In such systems, water is vaporized by the flue gases from the combustor and both the flue gas and the steam are injected down the well bore. This essentially eliminates, or at least reduces, the requirement to address the air pollution from the combustion process as all combustion products are injected into the reservoir and a large portion of the injected pollutants remain sequestered in the oil reservoir. The injected mixture conventionally has a composition of about 60% to 70% steam, 25% to 35% nitrogen, about 4% to 5% carbon dioxide, less than 1% oxygen, depending if excess of oxygen is employed for complete combustion, and traces of $SO_2$ and $NO_x$. The $SO_2$ and $NO_x$, of course, create acidic materials. However, potential corrosion effects of these materials can be substantially reduced or even eliminated by proper treatment of the water used to produce the steam and dilution of the acidic compounds by the injected water.

There is a recognized bonus to such an operation, where a combination of steam, nitrogen and carbon dioxide are utilized, as opposed to steam alone. In addition to heating the reservoir and oil in place by condensation of the steam, the carbon dioxide dissolves in the oil, particularly in areas of the reservoir ahead of the steam where the oil is cold and the nitrogen pressurizes or re-pressurizes the reservoir.

A very serious problem, however, with the currently proposed above ground high pressure system is that it involves complex compression equipment and a large combustion vessel operating at high pressures and high temperatures. This combination requires skilled mechanical and electrical personnel to safely operate the equipment.

One solution to the problems of the surface generation is to position a steam generator downhole at a point adjacent the formation to be steamed, which injects a mixture of steam and flue gas into the formation. This also has the above-mentioned advantages of lowering the depth at which steaming can be economically and practically feasible and improving the rate and quantity of production by the injection of the steam-flue gas mixture.

While many downhole steam generators have been proposed, current designs are generally very complex causing issues during manufacture and operation. Additionally, current designs require frequent maintenance due to hard water build up or ignitor failures, as the downhole conditions are extreme. Durability is very important since any time maintenance is required, the tool must be removed from the well which is time consuming and expensive.

Therefore, a durable steam generator tool is required. Such a tool can be used on surface or downhole.

SUMMARY OF THE INVENTION

In accordance with one aspect, the invention relates to a tool for generating steam and combustion gases for producing oil from an oil well, the tool comprising: a first end configured to receive inputs, the inputs including air, fuel and water; an ignition component arranged within the tool configured to ignite fuel and air to generate a flame; a combustion chamber accommodating the flame and extending at a second end opposite the first end, defined by a wall and an outlet configured to allow the exit of combusted products; and a water passageway that extends from the first end of the main body and terminates at a nozzle on an outer surface of the tool, the nozzle directing flow of water at least in part axially along an exterior length of the wall, wherein water is at least partially vaporized along the exterior length of the wall to generate steam.

In another embodiment, the invention relates to a method for generating steam from the steam generator tool for producing oil from the oil reservoir, the method comprising: supplying air, water, fuel and power or control to the steam generator; ejecting water from a nozzle on an exterior surface of the steam generator; igniting a flame using an ignition component; vaporizing water ejected from the nozzle by allowing water to flow along a length of an exterior surface of a wall of the combustion chamber towards an outlet of the combustion chamber while combusted products from the flame are flowing inside the combustion chamber towards the outlet of the combustion chamber, and directing the steam and the combusted products into the oil reservoir.

Another aspect of the invention relates to a tool for generating steam and combustion gases for producing oil from an oil well, the tool comprising: a first end configured to receive inputs, the inputs including air, water and fuel, wherein the air enters the tool at a port on an upper portion of the first end, the port devoid of any connections and configured to open the tool to an outer surface; a site on the first end of the tool configured to couple input lines of water and fuel to the tool; an ignition component arranged within the main body configured to ignite air and fuel to generate a flame; a combustion chamber accommodating the flame and extending at a second end opposite the first end, the combustion chamber defined by a wall and an outlet configured to allow exit of combusted products into the well; and a passageway within the tool from the port to the combustion chamber to allow flow of air from the port to the combustion chamber.

BRIEF DESCRIPTION OF THE DRAWINGS

For a better appreciation of the invention, the following Figures are appended.

DETAILED DESCRIPTION

The detailed description and examples set forth below are intended as a description of various embodiments of the present invention and are not intended to represent the only embodiments contemplated by the inventor. The detailed description includes specific details for providing a comprehensive understanding of the present invention. However, it will be apparent to those skilled in the art that the present invention may be practiced without these specific details.

The invention generally relates to a steam generator tool and method of steam generation, either downhole or on the surface, for steam and flue gas injection into an oil reservoir.

While steam injection is often used in the recovery of heavy oil, aspects of the invention are not limited to use in the recovery of heavy oil but are applicable to general steam generation. Applications include but are not limited to steam generation for heavy oil recovery or other industrial applications, water purification etc. In addition, the steam generator tool when employed for heavy oil recovery may be used in any of multiple configurations, for example, on surface, downhole in vertical, horizontal or other wellbore orientations.

Figure 1:
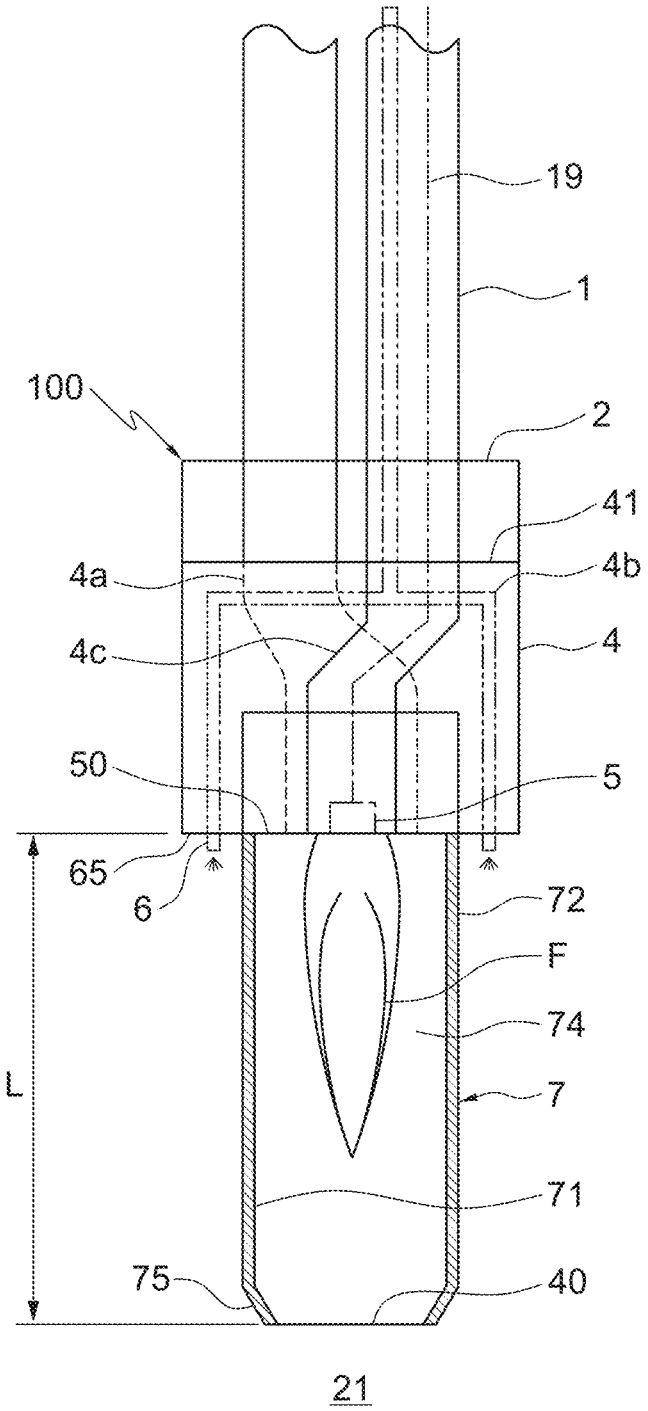
FIG. 1 is a cross section view of a steam generator tool with a flame therein.
Figure 3A:
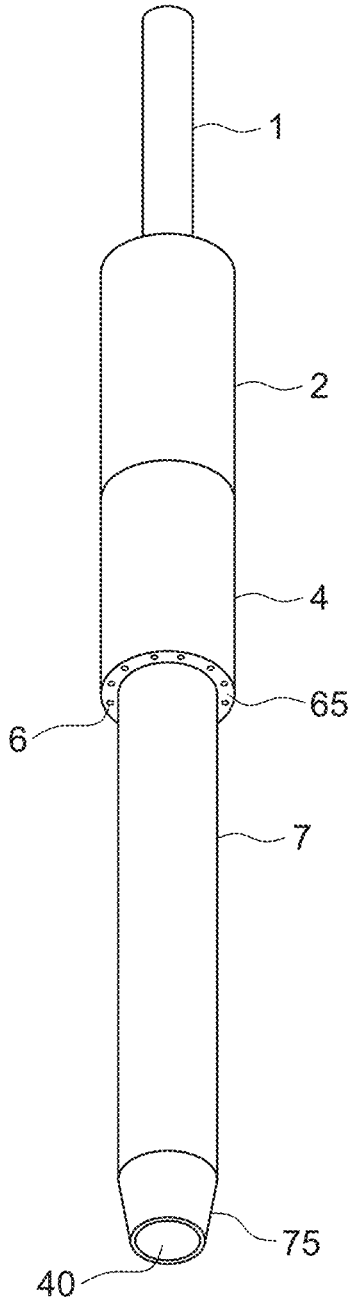
FIG. 3A is a perspective view of the steam generator tool showing nozzles on an exterior surface of the tool.
Figure 3B:
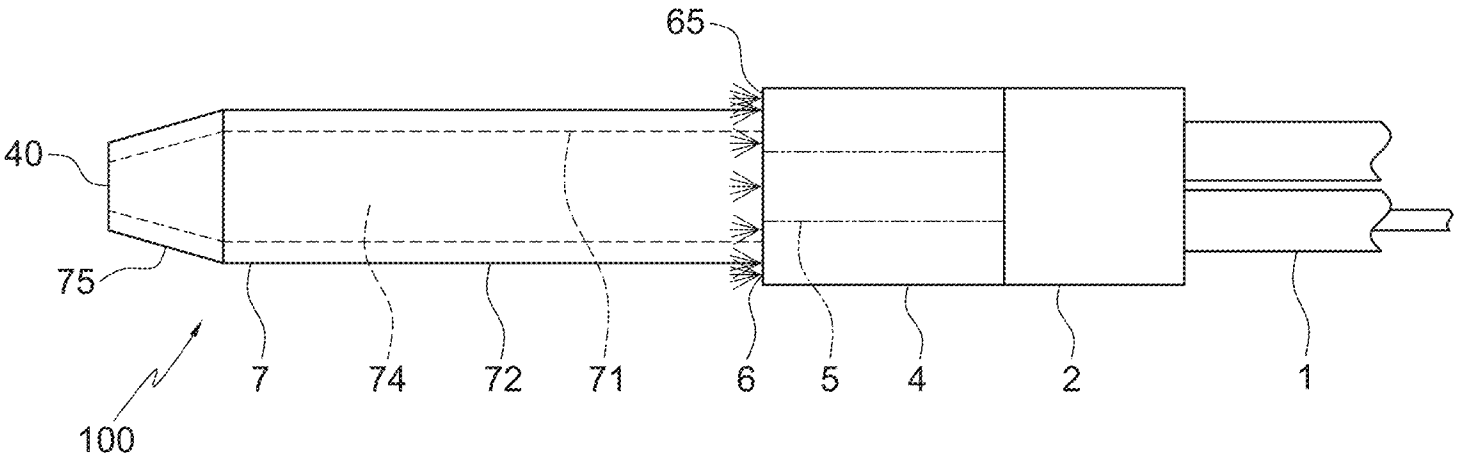
FIG. 3B is a perspective view of the steam generator tool showing nozzles in operation.

With reference to the drawings, FIGS. 1, 3A and 3B illustrate a steam generator tool 100 configured to receive a supply of fuel and water and, therefrom, to combust the fuel and generate steam from the water. The tool can be used downhole or on surface. In the illustrated embodiment of FIG. 1, tool 100 includes: a tool coupling component 2 configured to receive inputs of water, fuel and oxidant; a flow diversion component 4 coupled to the coupling component and which directs the inputs through the tool; and an ignition component 5 configured to ignite the fuel to produce a flame F. Tool 100 further includes a combustion chamber 74 configured to accommodate the flame; and a plurality of water nozzles 6, on the external surface of the tool. The nozzles each have an orifice and are configured to eject water onto the outer surface of the combustion chamber 74. The water is converted to steam during operation of the tool 100. The tool coupling component 2 defines a first end, which may be considered the upper end of the steam generator tool, and the combustion chamber is at the second, opposite end of the tool.

The coupling component, flow diversion component 4, ignition component 5, etc. may be separate, but coupled parts of the tool or they may be permanently coupled, such as integral, but simply functional areas of the tool.

In use, one or more supply lines 1 may be provided for coupling to the tool for delivery of inputs. Lines 1 are received at the tool coupling component 2. The tool's coupling component 2 is configured to receive and couple with any lines 1. Inputs may be received by the component 2 with connections that may be appropriately sealed and allow for ease of replacement, repair and modification. For example, the tool coupling component 2 may include one or more connectors providing a link between the multiple inputs and passages leading to the flow diversion component 4. The lines 1 may provide pressurized delivery of inputs such as oxidant (for example air), fuel and water, or ignition control to the tool coupling component 2.

The flow diversion component 4 delivers fuel and air from component 2 to the ignition component 5 and delivers water from component 2 to the nozzles 6. The flow diversion component 4 has a first end 41, which receives supplies from the tool coupling component 2. The flow diversion component 4 directs the supplies within the tool for their use and consumption. Fuel and air may be supplied into the tool by the lines 1, diverted through the tool by the flow diversion component 4 and released into combustion chamber 74, where they are combusted. Water may be introduced into the tool from line 1, diverted to water nozzles 6 by the flow diversion component 4, where the water is released and, in use, partially vaporized to steam as the water flows along the combustion chamber outer wall or into the hot combustion gases exiting the combustion chamber.

Specifically, flow diversion component 4 includes a plurality of passageways 4*a*, 4*b*, 4*c* through which the inputs of fuel, water and oxidant flow. The passageways include: an oxidant passageway 4*a* extending from the first end of the tool, such as from an inlet thereon, to the combustion chamber, a water passageway 4*b* extending from the tool's coupling component 2 to the nozzles 6*a* and a fuel passageway 4*c* extending from the tool's coupling component 2 to the combustion chamber 74. Flow diversion component 4 can also accommodate power/control lines or passageways, extending between upper end 41 and various locations in the tool such as ignition component 5.

The ignition component 5 is configured to ignite the fuel and oxidant flowing into the combustion chamber, for example in typical embodiments, ignition component 5 has a portion open to the combustion chamber 74. Once ignited, the fuel and oxidant flows continue to flow into, and burn within, the combustion chamber 74. The ignition component may be a spark generator, heated surface, etc. In another embodiment, the ignition component may include a delivery system for pyrophoric or hypergolic liquids.

The ignition component 5 may be controlled by a control system that determines when the ignition component is operated. The control system may have other operations such as to regulate the stability of the flame, the degree of fuel combustion, or to measure the stoichiometric data, pressure of air and fuel supplied to the tool. Therefore, the control system may include sensors such as located within the flow diversion component 4, ignition component 5 or combustion chamber 74. The tool may, for example, have an ignition control line that couples with a control line 19 in line 1. Ignition control line 19 may require electrical connections at component 2.

The combustion chamber 74 extends at the second end of the tool opposite the upper end. The combustion chamber is defined as the space within a tubular wall 7 extending at the second end. The tubular wall has a length L extending axially from a closed end, base wall 50 to an open end that forms an outlet 40 from the chamber. Length L may be between 300 and 1000 mm between the closed end and the open end, depending on the tool operation parameters and output requirements.

The combustion chamber wall 7 has an interior surface 71 facing into the combustion chamber and an exterior surface 72, which in the embodiment of FIG. 1 is a portion of the tool's outer surface. Wall 7 may be substantially cylindrical, for example a hollow cylindrical shape, in which case the interior surface 71 and the exterior surface 72 may be generally cylindrical with the interior surface being the inner diameter of wall 7 and the exterior surface 72 being the outer diameter of wall 7 and defining the outer cylindrical surface thereof.

The combustion chamber 74 is defined within the confines of the base wall 50 and the interior surface 71 and its length L is between base wall 50 and outlet 40, which also defines the long axis of the tool and chamber 74. During operation, the flame resides in the combustion chamber 74, with the combustion products exiting the combustion chamber at the outlet 40.

The diameter of the outlet 40 of the combustion chamber may vary. In one embodiment, the diameter across the outlet 40 is smaller than the largest diameter across the combustion chamber 74. In other words, the diameter across the opening at outlet 40 may be smaller than the largest dimension across the inner diameter of wall 7. Wall 7 may, therefore, include a tapering end that defines the narrowed outlet 40. This tapered end may be referred to as a combustion nozzle 75. The combustion nozzle 75 influences the exiting combustion gases, as they are converged when passing through the narrower diameter. Thus, combustion nozzle 75 generates a backpressure in chamber 74, thereby influencing the evacuation of fluids from the chamber and mitigating backflow of fluids up into the combustion chamber.

As will be appreciated, with the fuel and oxidant entering the combustion chamber at or adjacent the base wall 50, the flame becomes anchored near the base wall and is protected within wall 7. Intense heat is generated by the flame from where it is anchored and downstream thereof along the flame and the path of the combustion products from the flame. The wall 7 of the combustion chamber, therefore, becomes extremely hot at a position radially outwardly from where the flame is anchored and downstream thereof to the outlet 40. The heat is transferred from the interior surface 71 to the exterior surface 72.

Nozzles 6 are connected at the ends of water passageways 4*b*. The nozzles are positioned on the exterior surface of component 4 adjacent wall 7 and are oriented and configured to spray water therefrom along the combustion wall's exterior surface 72 toward outlet 40. As water flows along the combustion chamber wall 7 towards the outlet 40 of the combustion chamber, the heated exterior surface 72 of the combustion chamber at least partially vaporises the water into steam. In particular, the heat from the flame F, at the exterior surface 72, causes the water ejected from nozzles to be at least partially vaporized to steam. In particular, rather than being positioned to eject water into the combustion chamber where the water could adversely affect the flame, the nozzles are positioned outside the chamber on exterior surface 72. As such, the nozzle orifices open adjacent to the radially outer facing surface 72 of the combustion chamber wall and in one embodiment are configured to eject water at least in part axially along the outer surface 72 of the wall 7.

Nozzles 6 in addition to their location on the exterior surface of the tool, may be positioned at approximately the location where the fuel and oxidant enter the combustion chamber. For example, the flame becomes anchored at or slightly downstream of where air and fuel are combined and ignited, in the combustion chamber. Thus, while the nozzles 6 are on the exterior surface of the tool outside the combustion chamber, the nozzles may be positioned at approximately the same axial position as the passageway openings of air 4*a* and fuel 4*c* to chamber 74. This positions the nozzles at the approximately the same axial position as where fuel and air are entering the combustion chamber and just upstream of where the fuel and air are combusting. Therefore, the location of nozzles 6 at approximately the same axial position as the passageway openings of air 4*a* and fuel 4*c* to chamber 74, allows water to be released from passageways 4*b* through the nozzles at a cooler area on the exterior surface of the tool, while water is directed to pass along or impinge on the much hotter tool surface radially outwardly from where the flame sets up.

In the illustrated embodiment, the openings for passageways of air 4*a* and fuel 4*c* to chamber 74 are at base wall 50 and therefore nozzles 6 are located at approximately the location of the base wall 50, which is the upper, closed end of the combustion chamber. The nozzles are positioned near or on the outer surface of the combustion chamber wall radially outwardly from the base wall 50 of the combustion chamber 74. In one embodiment, the nozzles may be on the exterior surface of the flow diversion component 4 positioned substantially level, for example substantially coplanar with the ignition component 5 and the openings for passageways of air 4*a* and fuel 4*c* within combustion chamber 74, which are all at base wall 50.

The position of the nozzles at the same axial position as base wall 50 ensures that water is released from passageways 4*b* through the nozzles before the water reaches the hottest area of the tool, which is on wall 7 between where the flame becomes anchored and the outlet end 40. Thus, water passageways 4*b* extend only through coupling component 2 and flow diversion component 4 to reach nozzles 6 and they do not extend through the tool adjacent past the hottest area of the tool. In one embodiment, passages 4*b* terminate at nozzles 6 without passing within wall 7.

The application of water from nozzles 6 to the exterior surface 72 generates a cooling effect at wall 7 where water partially vaporizes to form steam. Thus, this nozzle position protects the combustion chamber wall 7 from thermal degradation and provides a uniform temperature distribution around the combustion chamber wall 7. Also, while prior art tools experienced problems with scale build up and plugging of the water passageways and nozzles, the present tool positions the nozzles upstream from the hottest area of the tool to avoid scaling in the water passages and nozzles. While scaling may occur on the exterior surface of the tool, for example, on exterior surface 72 of wall 7, the large, open surface area ensures such scale does not occlude the water spray and tends fall away or be knocked off. While prior tools sometimes required softened water, the current tool with its unique nozzle positioning can work with impure water sources such as process water, surface water, brackish water, etc.

In one embodiment, exterior surface 72 of wall 7 is treated to resist buildup of scale from water evaporation. For example, the exterior surface at least between nozzles 6 and outlet end 40 may be polished or coated with a non-stick coating such as Teflon™, titanium ceramic compounds or similar materials. This surface treatment facilitates scale removal during use and routine maintenance.

Nozzles 6 may be spaced apart about a circumference of the tool such that water is applied around the entire circumference of exterior surface 72. The number of nozzles 6 depends on the flow rate, expected pressure losses and combustion chamber length.

In one embodiment, as shown in FIG. 3A and FIG. 3B, the nozzles 6 may be installed in a shoulder 65 on the outer surface of the tool. The shoulder may be defined by a change in the tool's outer diameter from a larger outer diameter at the upper end to a smaller outer diameter at the lower end. The shoulder may be between flow diversion component 4 and combustion chamber wall 7. The shoulder creates an annular face substantially perpendicular to the long axis of the tool. The shoulder 65 faces downward, such that the outer diameter of outer surface substantially at and above base wall 50 is greater than the outer diameter across exterior surface 72 of the combustion chamber wall. In one embodiment, nozzles 6 are mounted on the annular face of the shoulder with their orifices opening adjacent to the annular face and aimed towards the outlet 40 of the combustion chamber. As such, water is ejected axially away from the shoulder along the outer surface of the tool, parallel to the combustion chamber wall 7. Nozzles 6 may be spaced equally around the circumference of the shoulder to ensure adequate water coverage of the combustion chamber wall 7. FIG. 3B shows nozzles 6 in operation, where water is ejected concentrically from about the tool and toward the outlet 40. This provides a film of water along the exterior surface 72 of the combustion chamber wall 7.

Nozzles 6 may be selected for various spray delivery types including fan, jet/stream, mist, or spray. Additionally, the water pressure and water flow rate may be varied depending on the size of the tool, design criteria and power requirements of the tool.

Figure 2A:
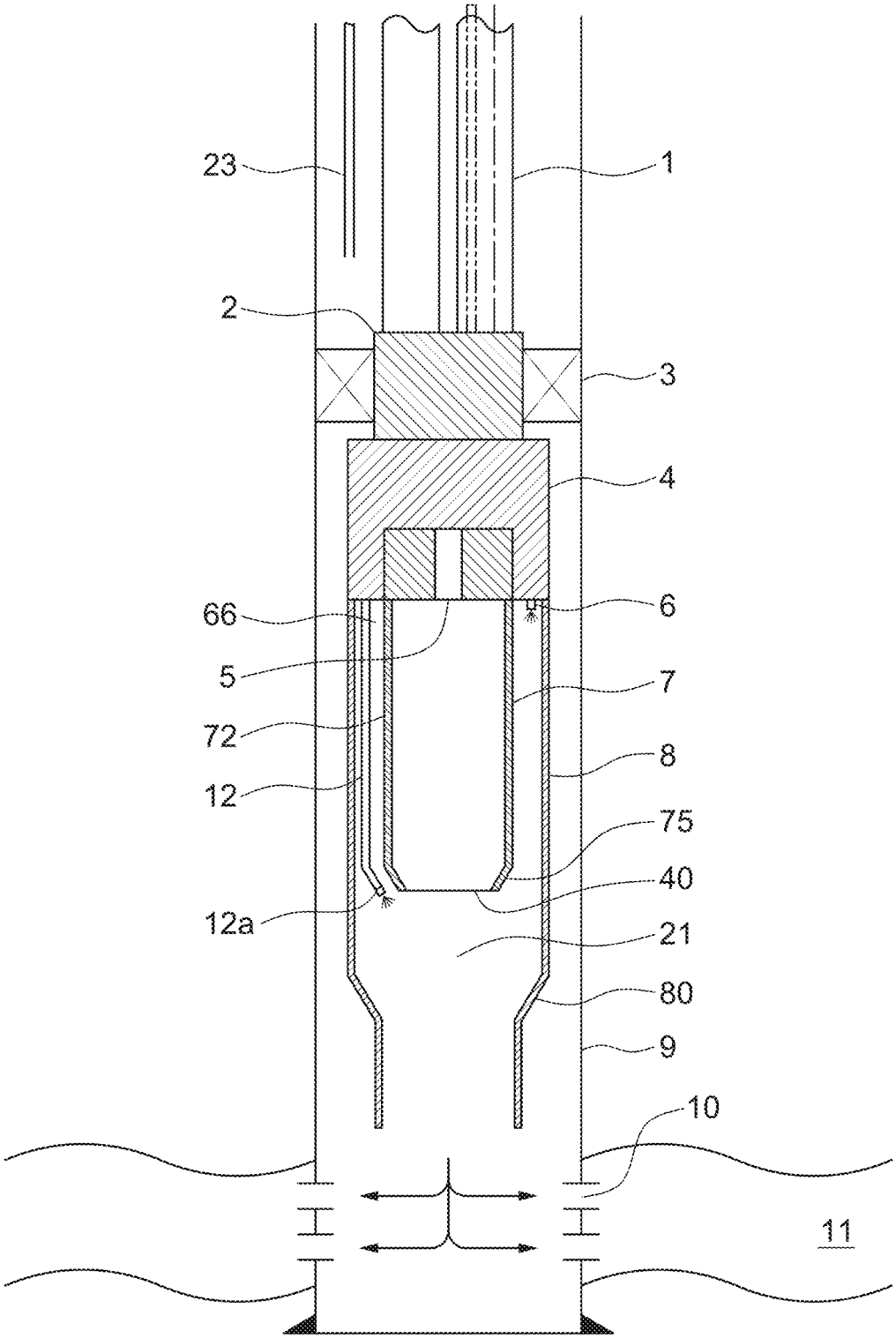
FIG. 2A is a cross section view of another steam generator tool in an oil reservoir showing further nozzles and an outer housing.
Figure 3C:
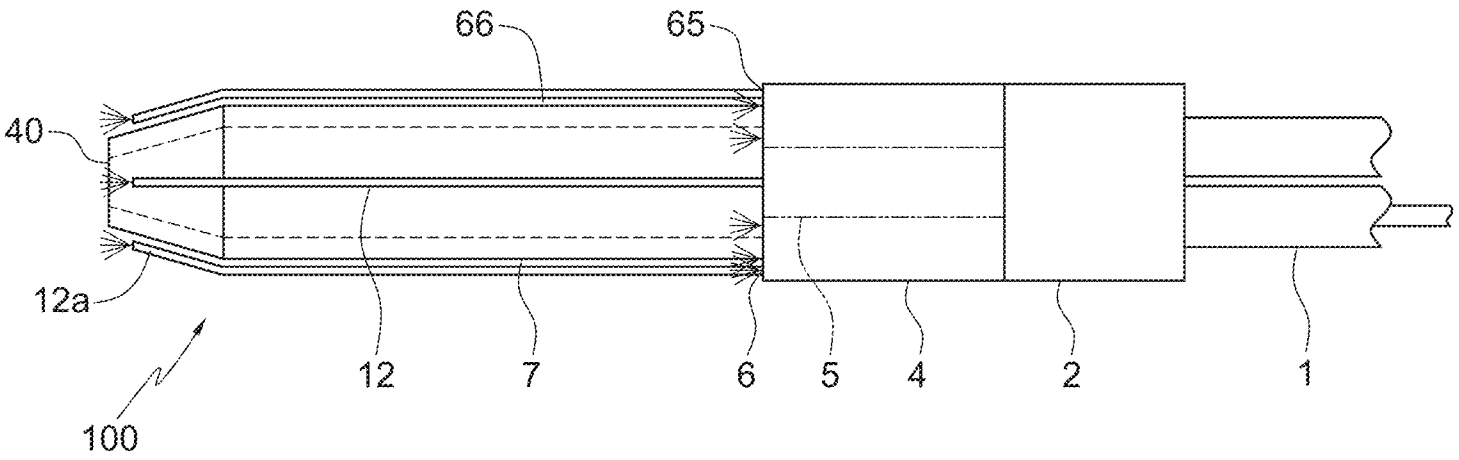
FIG. 3C is a perspective view of the steam generator tool showing nozzles and water extension conduits in operation.

If there is a desire for higher steam quality or the combustion products exiting the outlet are found to be too hot, it may be beneficial to provide further water extension conduits 12 with distal ends having nozzles 12*a* thereon, as shown in FIGS. 2A and 3C. Extension conduits 12 may be connected to some passageways 4*b* such as those terminating on shoulder 65. As shown in FIG. 3C, each tubular water extension conduit 12 may be connected to component 4, such as connected on to the shoulder 65, spaced apart and interspersed between the nozzles 6, and may extend along length L of the combustion chamber wall 7 to terminate proximate to the outlet 40 of combustion chamber. Water extension conduits 12 may be used in addition to nozzles 6 to provide an additional source of water. Water supplied to the tool may be supplied to and ejected from both water nozzles 6 at base wall 50 and water nozzles 12*a* fitted to extension conduits 12. FIG. 3C shows how water may be ejected simultaneously from water extension conduit nozzles 12*a* and nozzles 6.

Nozzles 12*a* are positioned close to the outlet 40, where hot combustion gases exit the tool into space 21. Thus, nozzles 12*a* of extension conduits 12 can be positioned to eject the water close to or directly into the combustion gases. Water supplied to the tool is directed into water extension conduits 12 and ejected by nozzles 12*a* into the space 21 where hot combustion gases exit from outlet 40 of the combustion chamber, thereby vaporizing the water to steam. There may be a plurality of water extension conduits 12 and nozzles 12*a* as shown in FIG. 3C.

Water extension conduits 12 may deliver water directly to the outlet 40 where combustion gases exit into space 21. The introduction of water directly into the exiting combustion gases, may serve to more directly cool the combustion gases. In particular, water extension conduits 12 permit direct cooling of the hot combustion gases 21 that pass from the outlet 40 of the combustion chamber. The water extension conduits 12 may eject water axially relative to the wall or may be angled inward towards the outlet 40 of the combustion chamber. Thus, water ejected from the nozzles 12*a* may be directed axially or at an angle radially inwardly toward or below the outlet. For example, a distal end of the water extension conduits 12 may be angled a at least 45° towards the outlet 40 providing ejection of water into the space 21 below the outlet where hot combustion gases exit the combustion chamber. The number of water extension conduits 12 may vary depending on the desired steam quality to be obtained, size of the well, application and design of the tool. For example, for a tool intended for use in a well having an inner diameter of less than 229 mm or less than 178 mm, between 4 and 8 water extension conduits 12 may be provided.

Water extension conduits 12 with nozzles 12*a* have the greatest effect at a low power setting, for example 5 million BTU/hr. In this case, the water ejected from nozzles 12*a* helps to cool the hot combustion gases exiting the outlet 40 of the combustion chamber.

Water extension conduits 12 are connected to the tool by mechanical coupling or welding. As shown in FIG. 2A, water extension conduits may barely touch or be spaced from the exterior surface 72 of the combustion chamber. In one embodiment, there is a space 66 between each conduit 12 and surface 72. Thus, water extension conduits 12 may be insulated from the intense heat of wall 7 by the film of water supplied from nozzles 6 that may flow into the space 66 between the water extension conduits 12 and the exterior surface 72 of the combustion chamber.

Figure 2B:
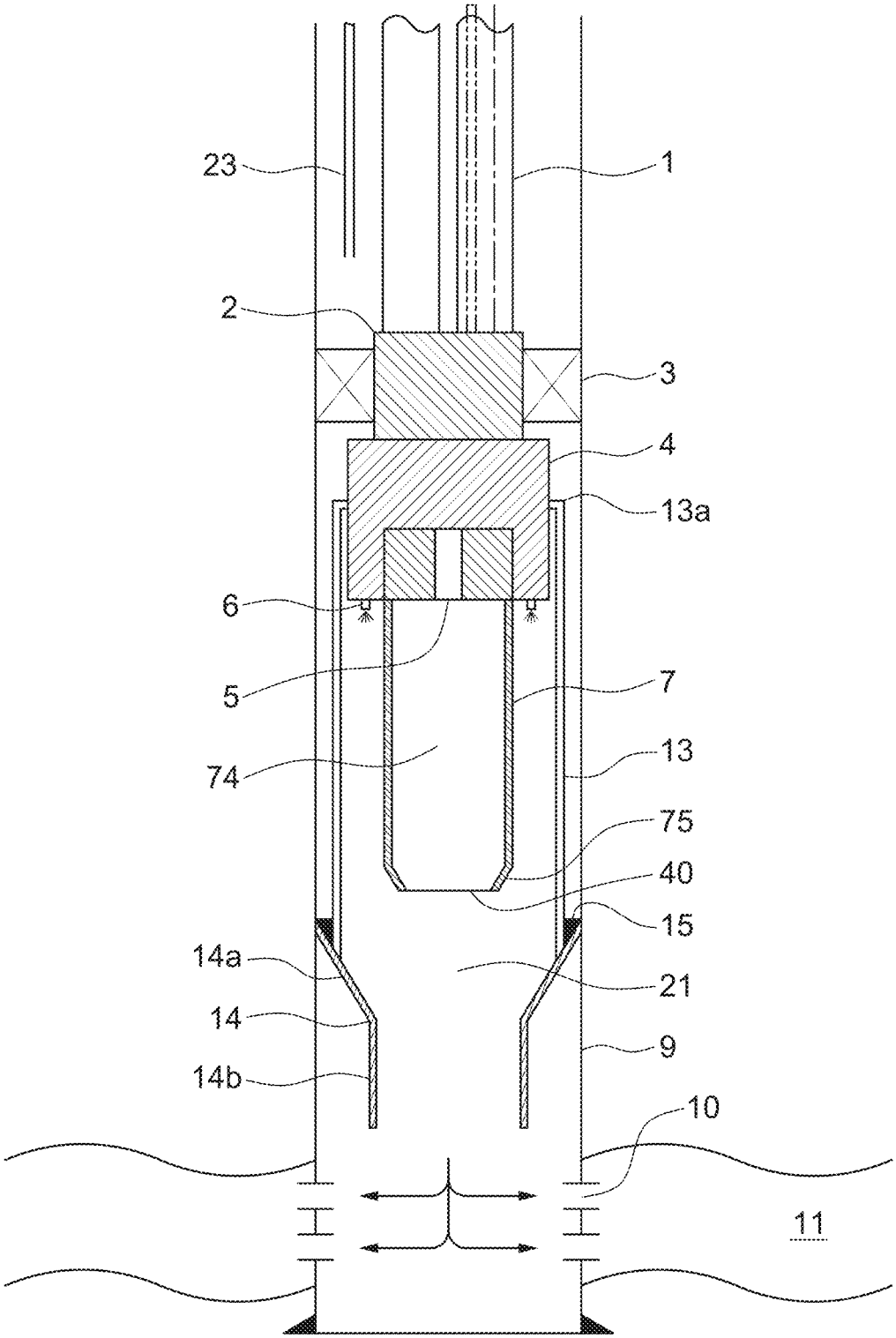
FIG. 2B is a cross section view of another steam generator tool in the oil reservoir with mixing apparatus supports and reducer cone optional embodiments.

As noted, the tool can be used downhole or on surface. When used downhole, the tool is installed with combustion chamber 74 and nozzles 6 open to the area of the well, such as a formation 11 to be steam treated. FIGS. 2A and 2B show tools 100 each installed within a well. An isolating packer 3 secures the tool within the wellbore wall, herein shown as casing 9. Isolating packer 3 isolates the lower, steam-generating end of the tool from the well above the packer. Thus, packer 3 maintains the steam and heat from combustion chamber 74 downhole and prevents the steam from flowing upwardly along the annulus away from the oil reservoir 11. The tool may be installed proximate to the perforations 10 and oil reservoir 11 to reduce possible damage and loss of energy to the well casing 9 and other formations above the oil reservoir. Isolating packer 3 has one or more of mechanical, hydraulic, inflatable, swellable or slip less packer elements.

Isolating packer 3 is installed concentrically around the outer surface of the tool, above the tool on a connected but separate tool or on the lines 1. The packer 3 is initially in a retracted position, when not in use or when being tripped into the well, but when in position in the well, it is set by expanding the packer elements.

In one embodiment, the isolating packer is installed about a circumference of the tool between the coupling component 2 and the nozzles 6. Thus, when set in the well, the coupling component is uphole of the packer and nozzles 6 and outlet 40 are downhole of packer 3. Packer 3 isolates coupling component 2 from communication with the nozzles except through passageways 4*a*, 4*b*, 4*c*.

When installed in a well, an annular cooling system 23 may be employed uphole of the tool above packer 3.

Figure 2C:
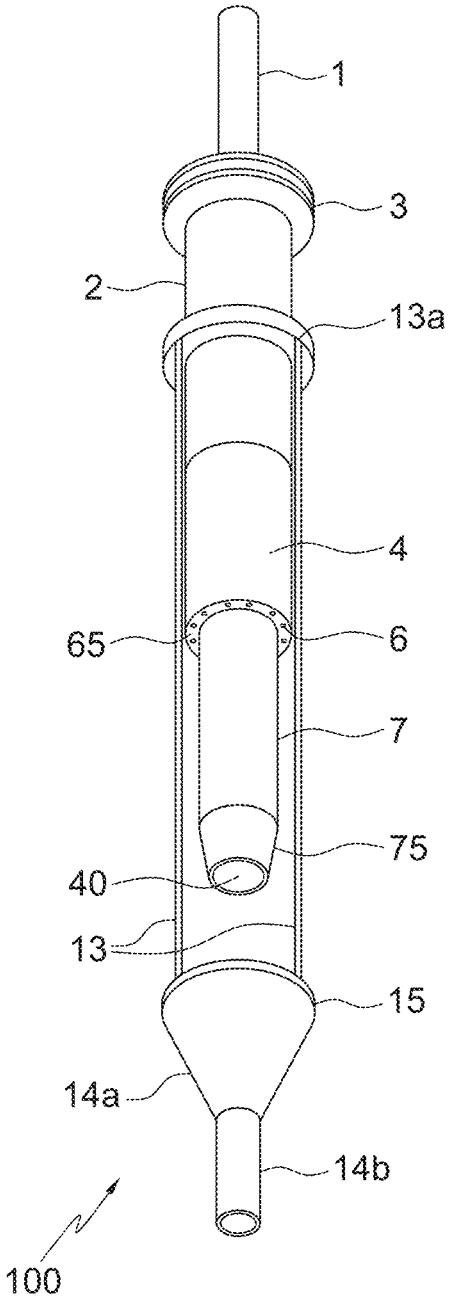
FIG. 2C is an isometric view of the steam generator tool including mixing apparatus supports and a reducer cone with extension.

FIGS. 2A to 2C illustrate further possible steam generator tools. The illustrated tools have a converging structure for forced mixing of any unvaporized water, steam and combustion gases in downstream of outlet 40 of the combustion chamber. The converging structure is useful to control outputs of heat and steam from the tool. The converging structure forces radial inward flow, and thereby mixing, of any unvaporized water and steam into the flue gases exiting outlet 40, thereby both vaporizing the water and cooling the flue gases. The converging structure may include a reducer cone 14 on the second, lower end of the tool below outlet 40 with space 21 therebetween.

The reducer cone includes conical, funnel shaped, tapering side walls that converge from an inlet, open upper end 14*a* to an outlet, open lower end 14*b*. The cone's lower end has a smaller diameter opening than its upper end. The wider upper end is positioned on the tool closer to the outlet 40 than the lower end 14*b*.

In one embodiment, the open upper end 14*a* of reducer cone 14 has a diameter greater than the diameter across outlet 40 and forces any unvaporized water, steam passing along the outer surface 72 to converge with the combustion gases exiting outlet 40. In particular, the upper end 14*a* forces the fluids in space 21 to converge to pass through the smaller diameter lower outlet 14*b*. In one embodiment, the upper end of reducer cone 14 is about the same diameter as the wellbore casing in which the tool is to be used, which is about the same diameter of packer 3 when set. Therefore, any fluids in area 21 below outlet 40 have to pass through the reducer cone as they move away from the tool. The smaller diameter lower outlet 14*b* may be lengthened by a cylindrically shaped solid wall extension of consistent diameter, to control flow dynamics of exiting steam and combustion flue gases. For example, the extension may mitigate the formation of eddy currents as fluids exit cone 14.

Reducer cone 14 may be coupled onto the tool in any of various ways, such that it is positioned substantially concentric with, and spaced below, the outlet 40. If there is concern about tool control or casing damage, the converging structure may include a substantially solid cylindrical housing 8 to couple cone 14 in position on the tool. Such a tool is illustrated in FIG. 2A. In such a tool, outer housing 8 encases the lower end of the tool including wall 7 with nozzles 6 therebetween. Housing 8 supports, at its lower end, the reducer cone 14 spaced from and below outlet 40 of the combustion chamber. The outer housing may be a cylindrically shaped solid wall. Since nozzles 6 open into the annular space between outer housing 8 and wall 7, the outer housing 8 and reducer cone 14 contain the water from nozzles 6, and the resulting steam and flue gases initially within the tool. For example, water ejected from nozzles 6 creates flow of water between combustion chamber wall 7 and the interior of the outer housing 8. A tool with outer housing 8 may be operated at higher steam qualities (>80%) without damaging the well casing 9. As such, housing 8 becomes sacrificial and protects the casing 9 from the intense heat generated alongside wall 7. Housing 8 can be removeably attached to the tool, such as to component 4, and it can be replaced during maintenance.

Optionally, a non-stick treatment, such as a coating as noted above, may be applied to the interior surface of the outer housing.

In another embodiment, as illustrated in FIGS. 2B and 2C, the tool includes support arms 13 that couple the reducer cone 14 on the second end spaced from and below outlet 40. Support arms 13 extend beyond the lower end of wall 7. There are many options for support arms 13. While supports 13 may be configured to more completely surround exterior outlet 40 and area 21, in one embodiment, supports 13 are a plurality of spaced apart, thin, elongate, axially extending rods, with open areas there between, as shown in FIG. 2C. Having only a plurality of spaced apart rods instead of a solid cylindrical wall, reduces the weight, complexity and material requirements of the tool and leaves the annulus about wall 7 below nozzles 6 as open as possible.

In one embodiment, support arms 13 are connected by a collar 13*a*, secured concentrically on the tool above nozzles 6, for example, to the outer surface of component 4 below packer 3. Supports 13 then extend down along the main body and the combustion chamber wall and axially beyond outlet 40. Support arms 13 are, therefore, longer than the length L of wall 7 to extend from above nozzles 6 to terminate below outlet 40.

Support arms 13 and/or collar 13*a* may be further configured to act as centralizers for the tool relative to the casing in which the tool is installed. For example, the supports and/or collar 13*a* may protrude diametrically beyond the diameter of the tool's main body, components 2 and 4, to define an effective outer diameter that is about the same diameter as the wellbore casing in which the tool is to be used. Where the support arms are used as centralizers, there may be at least three spaced apart support rods that extend axially from at or above shoulder 65 and are circumferentially spaced to define an effective outer diameter that is about the same diameter as the wellbore casing in which the tool is to be used, which is about the same diameter as the upper end of cone 14 and of packer 3, when set, which is greater than the outer diameters of each of the tool components 2, 4 and wall 7.

The reducer cone upper end 14*a* rests close to or against the well casing 9, since as noted, the upper end diameter is about the same as the casing in which the tool is installed. In one embodiment, there is a seal 15 on the upper end of reducer cone 14. The seal may be a ring that extends around the entire circumference of upper end 14*a* and the ring diameter is selected to be biased against the well casing 9. Seal 15 may be made of a variety of high temperature resilient materials, for example, high temperature rubber compounds, Teflon or similar materials.

In this embodiment, the well casing 9 is used to contain the water, steam and combustion products within the well below nozzles. For example, water from nozzles 6 and resulting steam flows along the space between well casing 9, arms 13 and wall 7, until it reaches seal 15 and cone 14 where it is converged inwardly into the flue gases exiting from outlet 40.

Figure 4A:
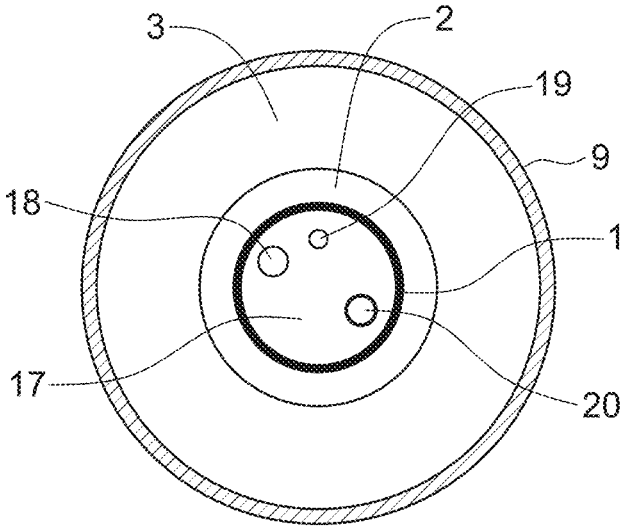
FIG. 4A is a top plan view of a steam generator tool as installed and connected to surface with a coiled tubing umbilical.
Figure 4B:
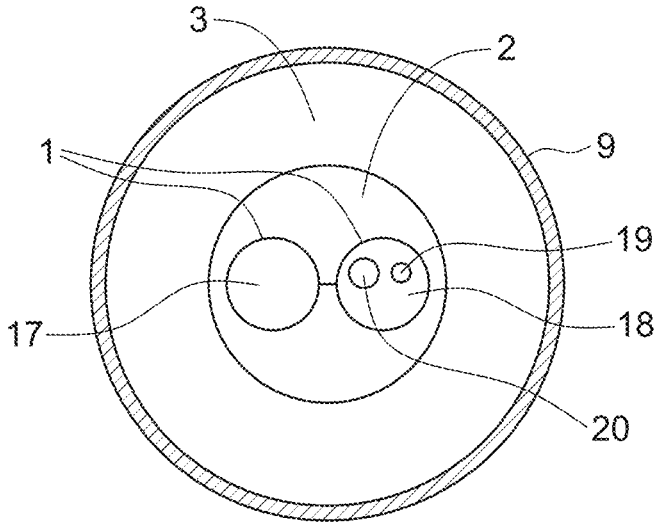
FIG. 4B is a top plan view of a steam generator tool as installed and connected to surface with a multi-conduit umbilical.
Figure 4C:
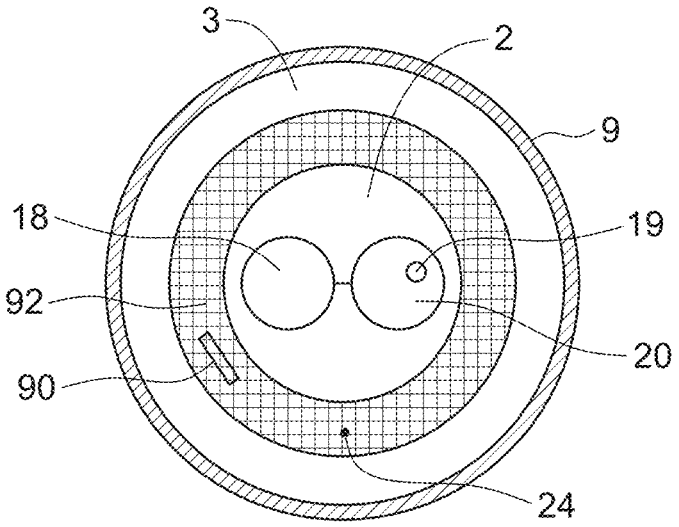
FIG. 4C is a top plan view of a steam generator tool installed, connected to surface with a coiled tubing umbilical and with an annular bypass for oxidant input.

FIGS. 4A to 4C show top plan views of a plurality of tools installed in well casing 9. These Figures illustrate optional configurations for the input lines 1 such as those lines for air 17, fuel 18, ignition control/power 19 and water 20. In the embodiment of FIG. 4A, all the lines are bundled together with a larger diameter tubing accommodating smaller diameter tubes therein. The fuel, water and control lines 18, 19, 20 are the smaller diameter lines and the air line 17 is effectively the remaining space within the larger diameter tube. The tool coupling component 2 includes a connection site for the larger diameter tube through which air is flowing and connection sites for each of water 20, fuel 18, and ignition control 19.

In another embodiment, a plurality of the lines may be bundled, for example configured as a multi-conduit umbilical 1*a*, as shown in FIG. 4B. Multi-conduit umbilical 1*a* may be coupled to the tool at the tool coupling component 2. A multi-conduit umbilical may be bundled using tubing, concentric coiled tubing, flexible braided hose, wraps. One multi-conduit umbilical is known as Armorpak™ tubing and is described in U.S. Pat. No. 10,273,790.

The outer diameter of the lines 1, la may depend on the pressure requirements of the application of the tool. For example, for heavy oil production, the outer diameter of the tubing may range between 60 and 114 mm and between 15 and 60 mm for Armorpak tubing. Inputs lines such as air line 17 or fuel line 18 may deliver the largest volume of inputs to the tool when compared to water 20 and therefore may be configured to rigidly secure the tool 100 to the surface during downhole applications.

Figure 4D:
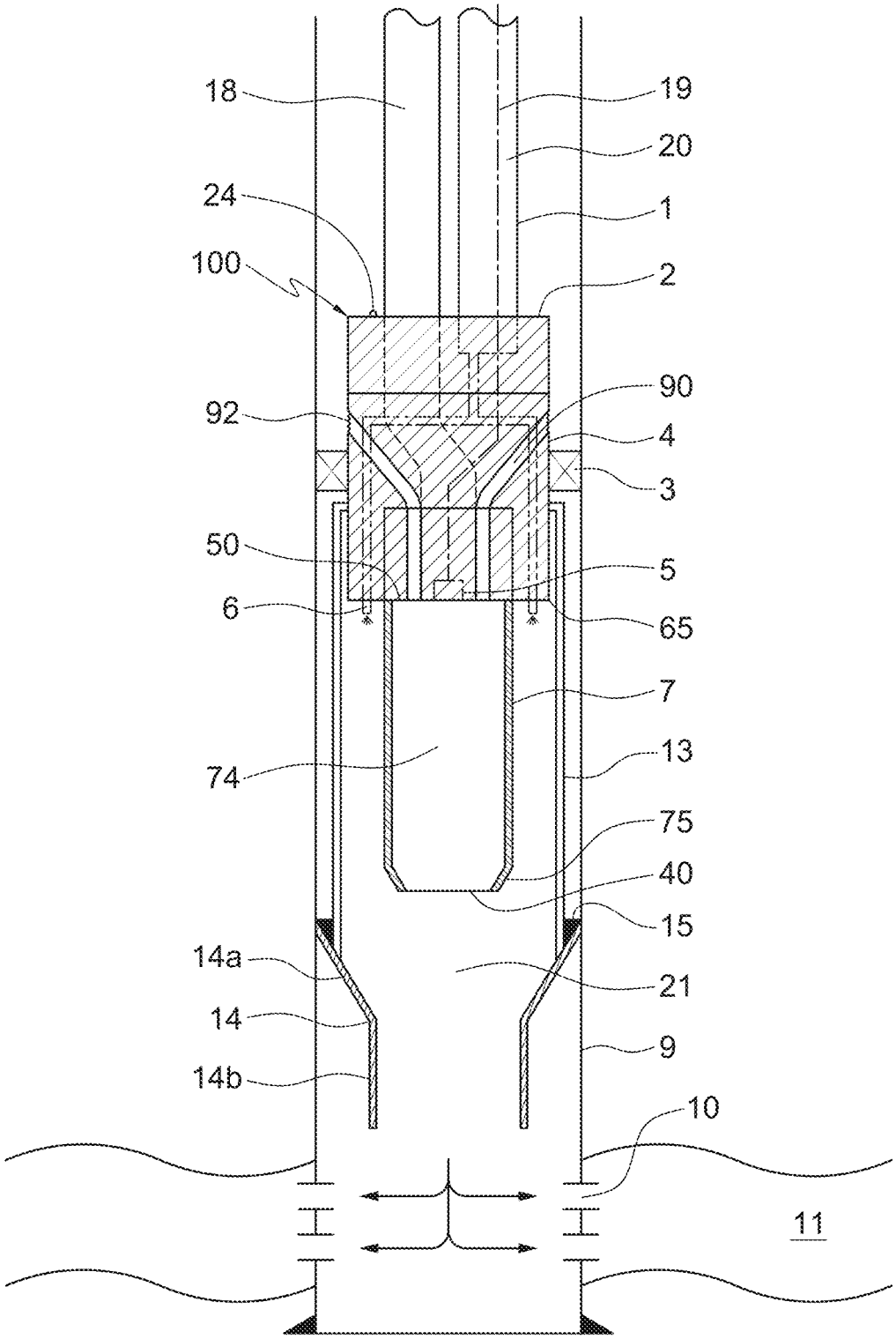
FIG. 4D is a cross section view of the steam generator tool including the annular air bypass.

In an alternative embodiment shown in FIGS. 4C and 4D, the tool is configured to receive air from the environment through a port 90 on the tool outer surface rather than from a supply through a line. In such an embodiment, tool 100 includes oxidant inlet port 90 on its upper end such as on tool components 2 or 4. While fuel line 18, water line 20 and control line 19 are each connected at separate or bundled sites to tool, air is provided though the annulus of the well and enters tool at port 90. Port 90 may be devoid of any type of connections for input lines, for example, quick connections, threaded connections, Armorpak connections, coiled tubing connections or bundled connections. Port 90 communicates with a passageway that leads to the combustion chamber. The passageway may be configured to allow air to flow from the port 90 to the combustion chamber. There may be a debris or water trap such as a screen 92 over port 90 to prevent plugging of port 90 and its passageway with debris or impurities. In this embodiment, there is no line that supplies air to the tool, instead air may be drawn into the tool from the wellbore uphole of the tool. Oxidant such as air may be pumped into the wellbore uphole of the tool. Port 90 provides an annular bypass through tool. The annular bypass may be used, for example, in instances where large volumes of air are required. In these cases, using the annular bypass allows for surface and injection pressures to be reduced to manage the total pressure on the system.

Air from within well casing 9 can flow into port 90 and be diverted via the flow diversion component 4 to chamber 74. During downhole operations, annular bypass via port 90 permits lower operating pressures at the surface of the well compared to line delivery of oxidant, as the flow area in the annulus is several times larger than the flow area through input lines 1. As a result, the port 90 may be useful when well casing 9 is narrow to provide optimal operating pressures at the surface of the tool. In addition, compressors used to deliver inputs downhole may be more economical when air is delivered through port 90. By using the annulus to deliver air through port 90, supplementary fuel 17 and water 20 may be delivered through input lines 1.

In another aspect of the invention as shown in FIG. 4C, the tool includes a temperature sensor 24, which may be monitored via lines 1 or remotely. Other sensors may also be used, for example, a pressure or chemical sensor. Sensors may detect parameters indicative of operations or faults such as overheating or leaks. There may be sensors above (as shown) and below the packer 3.

The outer diameter of the steam generator tool 100 may vary depending on the inner diameter of the well casing 9. The steam generator tool must have an outer diameter smaller than the inner diameter of the well casing 9. Typically, the inner diameter of the well may be less than 200 mm or less than 125 mm, in such cases the tool may have a maximum outer diameter of about 190 to 120 mm to fit within well casing 9.

During downhole applications of the steam generator tool, the outer diameter of the tool may be limited by the size of the well casing 9, whereas during surface applications of the tool there is no size limitation.

In another embodiment there is provided, a method for generating steam such as for injection to a reservoir 11 for producing oil from the oil reservoir. The method comprises: supplying air, water and fuel to the steam generator tool; igniting the fuel to create a flame within the combustion chamber 74; ejecting water out of the nozzles 6 along the exterior of the combustion chamber wall 7 such that the water partially vaporizes to form steam and flows along an exterior surface 72 of the combustion chamber wall 7 while combustion gases from the flame flow within the combustion chamber through the inner diameter defined within the interior surface 71 of the wall; and mixing the steam and the combustion gases at an outlet 40 of the combustion chamber. The mixture of steam and combustion gases may be communicated to the reservoir.

Supply of air, water and fuel to the tool may be achieved using various methods. For example, the multi-conduit umbilical may supply inputs to the tool. Alternatively, the space between the tool and the well casing 9, specifically the annulus may provide a path for inputs such as air, where the tool includes port 90. The ignition component 5 may be used to initiate combustion of the supplied fuel and air to produce the flame within the interior of the combustion chamber. Water flowing into the tool via the multi-conduit umbilical may be ejected through water nozzles 6 outside of the combustion chamber where the flame is anchored. Nozzles 6 may be oriented so that the water may be ejected at least in part axially towards the outlet 40 of the combustion chamber. Water flowing along the length L of the heated combustion chamber wall 7, cools the wall and is vaporized to steam. Only when the steam and any unvaporized water reach the lower end of the wall do they contact flue gases exiting at outlet 40.

The steam and combustion gases, and any unvaporized water, may be directed to converge, for example, by passing through reducer cone 14 before entering the oil reservoir 11. The reducer cone funnels and forces mixing of the steam and/or water after travelling along the combustion chamber wall 7 and combustion gases exiting the outlet 40 of the combustion chamber. This increases steam quality and reduces flue gas exit temperatures.

Because the tool vaporizes water on its outer surface, water supplied to the tool 100 may be impure, for example, fresh water, brackish water or seawater. The steam generated by the tool 100 may include super-heated steam.

A variety of different fuels may be employed, for example, natural gas, synthetic gas, propane, hydrogen or liquid fuels.

For use in typical oil reservoirs, the pressure of air or gases may be controlled to about 20 atmospheres (2,000 kPa) to about 70 atmospheres (7,000 kPa) and the output of the tool may be controlled to above 10 MM Btu/hr.

The tool is composed of materials selected to the rigors of down hole such as high temperatures, steam and corrosive fluids.

The components of the steam generator tool 100 are simple and flexible permitting ease of use, inspection, repair and modification. The tool and method of using the tool to produce steam reduces or delays environmental pollution. Due to the design and configuration of the components, the tool is able withstand high temperatures and pressures over repeated use. In addition, the tool is capable of pressurizing and/or re-pressurizing the oil reservoir as combustion gases and steam may be injected into the well at various pressures. The high power output of the tool provides extended operation in many applications.

CLAUSES a. A tool for generating steam and combustion gases for producing oil from an oil well, the tool comprising: a main body with a first end configured to receive inputs, the inputs including air, fuel and water, an ignition component within the tool configured to ignite fuel and air to generate a flame; a combustion chamber for accommodating the flame, the combustion chamber extending at a second end of the main body opposite the first end and defined by a wall and an outlet configured to allow the exit of combustion products; and a water passageway that extends through the main body from the first end and terminates at a nozzle on an outer surface of the tool, the nozzle configured to direct a flow of water at least in part axially along an exterior length of the wall outside of the combustion chamber, wherein water is at least partially vaporized along the exterior length of the wall to generate steam.

b. The tool according to any of the clauses, wherein the nozzle is located at about the position where the air and fuel enter the combustion chamber.

c. The tool according to any of the clauses, wherein the nozzle is located diametrically outwardly from an ignition device within the combustion chamber.

d. The tool according to any of the clauses, wherein the first end includes a connection site configured to receive an input line.

e. The tool according to any of the clauses, wherein the first end includes a port configured to receive air from an exterior surface of the tool apart from an input line.

f. The tool according to any of the clauses, wherein the inputs further include power or ignition control.

g. The tool according to any of the clauses, wherein the inputs are bundled.

h. The tool according to any of the clauses, further comprising a reducer cone spaced below the outlet of the combustion chamber, the reducer cone having an open upper end and an open lower end that is narrower than the upper end, the reducer cone configured to collect and combine steam and flue gases below the outlet.

i. The tool according to any of the clauses, further comprising a resilient seal encircling the open upper end of the reducer cone.

j. The tool according to any of the clauses, further comprising an outer housing that couples the reducer cone to the tool, the outer housing having a solid wall encircling the wall of the combustion chamber and with the nozzle positioned in an annular space between the solid wall and the wall.

k. The tool according to any of the clauses, further comprising support arms that couple the reducer cone to the tool, the support arms each being a rod-like structure extending beyond the outlet of the combustion chamber.

l. The tool according to any of the clauses, further comprising an isolating packer encircling the tool between the first end and the nozzle.

m. The tool according to any of the clauses, wherein the nozzle is one of a plurality of nozzles positioned about an exterior circumference of the tool.

n. The tool according to any of the clauses, further comprising a water extension conduit, the water extension conduit having a tubular structure which extends along the exterior length of the wall and terminates at an orifice proximate to the outlet of the combustion chamber, the orifice configured to eject water across the outlet of the combustion chamber.

o. The tool according to any of the clauses, wherein a distal end of the water extension conduit terminates at an inward angle relative the exterior length of the wall towards the outlet of the combustion chamber.

p. A method for generating steam from a steam generator tool to produce oil from an oil reservoir, the method comprising: combusting air and fuel within a combustion chamber of the steam generator tool; ejecting water from a nozzle on an exterior surface of the steam generator tool to thereby vaporize the water and generate steam external to the combustion chamber, and allowing the steam and flue gases from the combustion chamber to mix only after the flue gases exit the combustion chamber and prior to the steam and the flue gases contacting the oil reservoir.

q. The method according to any of the clauses, wherein ejecting water includes directing water against an external wall surface of the combustion chamber.

r. The method according to any of the clauses, wherein the combustion chamber is defined within a tubular side wall and further comprising inlets of fuel and air to the combustion chamber, and combusting includes anchoring a combustion flame within the side wall downstream of the inlets of fuel and air and ejecting water includes supplying water through the tool and releasing the water from the tool and against an external wall surface of the side wall.

s. The method according to any of the clauses, wherein releasing occurs between an upper end of the steam generator tool and a position diametrically outwardly of where the combustion flame is anchored.

t. The method according to any of the clauses, wherein ejecting water further includes spraying water across an outlet of the combustion chamber into the flue gases exiting the combustion chamber.

u. The method according to any of the clauses, further comprising forcing the steam and the flue gases through a converging cone positioned downstream of the combustion chamber.

v. The method according to any of the clauses, wherein air for the steam generator tool comes from the well above the tool apart from an inlet line.

w. The method according to any of the clauses, wherein the air enters the steam generator tool through a port on the exterior surface of the tool apart from an inlet line.

x. A tool for generating steam and combustion gases for producing oil from an oil well, the tool comprising:

a main body with a first end including a connection site for receiving a connection of an input line for fuel and/or water and an air inlet port configured to receive air from the atmosphere around the tool;

an ignition component arranged within the main body configured to ignite the air and the fuel to generate a flame;

a combustion chamber for accommodating the flame and extending at a second end of the main body opposite the first end, the combustion chamber defined by a wall and an outlet configured to allow exit of combusted products from the combustion chamber; and a passageway within the tool from the air inlet port to the combustion chamber to allow flow of air from the port to the combustion chamber; and optionally at least one of further comprising an isolating packer encircling the tool and wherein the air inlet port is positioned between an upper end of the first end and the isolating packer and wherein the air inlet port includes a component for screening water or debris from entering the passageway.

y. A method for generating steam from a steam generator tool, the method comprising: receiving air into the steam generator tool from the atmosphere within the well, which is open to an exterior surface of the steam generator tool; combusting the air and fuel within a combustion chamber of the steam generator tool to generate heat; and ejecting water to be vaporized into steam by the heat generated from the steam generator tool, and optionally wherein receiving air includes screening water and debris from the air at an exterior surface of the tool.

The description and drawings are to enable the person of skill to better understand the invention. The invention is not be limited by the description and drawings but instead given a broad interpretation.

We claim:

1. A tool for generating steam and combustion gases for producing oil from an oil well, the tool comprising:

a main body with a first end including:

(a) a connection site for receiving a connection of an input line for fuel and water, and (b) an air inlet port configured (i) to receive air from the atmosphere around the main body, and (ii) not to receive air from an air supply line, wherein the air inlet port provides an annular bypass of the air from the atmosphere through the tool; and an ignition component arranged within the main body configured to ignite the air and the fuel to generate a flame;

a combustion chamber for accommodating the flame and extending at a second end of the main body opposite the first end, the combustion chamber defined by a wall and an outlet configured to allow exit of combusted products from the combustion chamber; and a passageway within the tool from the air inlet port to the combustion chamber to allow flow of air from the air inlet port to the combustion chamber.

2. The tool of claim 1, further comprising an isolating packer encircling the tool and wherein the air inlet port is positioned between an upper end of the first end and the isolating packer.

3. The tool of claim 1, wherein the air inlet port includes at least one of a component for screening water or a screen for screening debris, the screen mounted in engagement with the main body and positioned at the air inlet port to screen debris from the air entering the air inlet port.

4. The tool of claim 1, further comprising a reducer cone spaced below the outlet of the combustion chamber, wherein the reducer cone comprises an open upper end and an open lower end that is narrower than the open upper end and is configured to collect and combine steam and flue gases below the outlet.

5. The tool of claim 4, further comprising a resilient seal encircling the open upper end of the reducer cone.

6. The tool of claim 4, further comprising an outer housing that couples the reducer cone to the tool, the outer housing having a solid wall encircling the wall of the combustion chamber.

7. The tool of claim 6, further comprising a plurality of nozzles positioned in an annular space between the solid wall and the wall.

8. The tool of claim 4, further comprising support arms that couple the reducer cone to the tool, the support arms each extending beyond the outlet of the combustion chamber.

9. The tool of claim 8, wherein the support arms are connected to each other via a collar encircling and protruding diametrically beyond the main body of the tool.

10. The tool of claim 9, wherein the collar is concentric with the wall of the combustion chamber.

11. The tool of claim 1, the ignition component comprising at least one of: a spark generator, a heated surface, a pyrophoric liquid delivery system, a hypergolic liquid delivery system, and/or any combination thereof.

12. The tool of claim 1, wherein the passageway terminates at an opening in an upper wall of the combustion chamber.

13. The tool of claim 1, wherein the air inlet port is devoid of a connection for an air input line.

14. A method for generating steam from a steam generator tool, the method comprising:

receiving, via an air inlet port open to an exterior surface of the steam generator tool and within a well in which the steam generator tool is installed, air into the steam generator tool from an atmosphere within a well, wherein the air inlet port provides an annular bypass of the air from the atmosphere through the steam generator tool;

receiving, via a connection of an input line, fuel and water into the steam generator tool;

combusting the air and the fuel within a combustion chamber of the steam generator tool to generate heat; and ejecting the water to be vaporized into steam by the heat generated from the steam generator tool.

15. The method of claim 14, wherein receiving air includes at least one of screening water, via a component, at the exterior surface of the steam generator tool or screening debris, via a screen, from the air at the exterior surface of the steam generator tool.

16. A wellbore installation for a well extending from surface into an earthen formation, the wellbore installation comprising:

surface equipment at the surface;

a tool installed fully within the well for generating steam and combustion gases for producing oil from the well, the tool comprising:

a main body with a first end including a connection site for receiving a connection of an input line for fuel and water and an air inlet port on an outer surface of the main body and configured to receive air from the atmosphere in the well around the main body, wherein the air inlet port provides an annular bypass of the air from the atmosphere through the tool;

an ignition component arranged within the main body configured to ignite the air and the fuel to generate a flame;

a combustion chamber for accommodating the flame and extending at a second end of the main body opposite the first end, the combustion chamber defined by a wall and an outlet configured to allow exit of combusted products from the combustion chamber; and a passageway within the tool from the air inlet port to the combustion chamber to allow flow of air from the air inlet port to the combustion chamber; and an input line for conducting fuel and water from the surface equipment to the tool.

17. The wellbore installation of claim 16, wherein the air inlet port includes at least one of a component for screening water or a screen for screening debris, the screen mounted in engagement with the main body and positioned at the air inlet port to screen debris from the air entering the air inlet port.

18. The wellbore installation of claim 16, wherein the air inlet port is devoid of a connection for an air input line.

* * * * *